US008947263B2

(12) United States Patent
Garay et al.

(10) Patent No.: US 8,947,263 B2
(45) Date of Patent: Feb. 3, 2015

(54) ASSESSING TRAFFIC STATUS WITH SENSORS

(71) Applicant: Google Inc., Mountain View, CA (US)

(72) Inventors: Csaba Zoltán Garay, Adliswil (CH); Douglas Antony Rinckes, Thalwil (CH)

(73) Assignee: Google Inc., Mountain View, CA (US)

( * ) Notice: Subject to any disclaimer, the term of this patent is extended or adjusted under 35 U.S.C. 154(b) by 7 days.

(21) Appl. No.: 13/769,220

(22) Filed: Feb. 15, 2013

(65) Prior Publication Data

US 2014/0232564 A1 Aug. 21, 2014

(51) Int. Cl.
*G08G 1/065* (2006.01)
*G08G 1/01* (2006.01)

(52) U.S. Cl.
CPC ..... *G08G 1/0116* (2013.01); *G08G 1/0129* (2013.01); *G08G 1/0112* (2013.01); *G08G 1/0141* (2013.01)
USPC ..... 340/934; 701/117; 701/119

(58) Field of Classification Search
CPC . G08G 1/0112; G08G 1/0108; G08G 1/0129; G08G 1/0104; G08G 1/0141
USPC ..... 340/934; 701/117, 119
See application file for complete search history.

(56) References Cited

U.S. PATENT DOCUMENTS

| | | | | |
|---|---|---|---|---|
| 7,260,472 | B2 * | 8/2007 | Sutardja | 701/117 |
| 2012/0123667 | A1 * | 5/2012 | Gueziec | 701/119 |
| 2012/0130625 | A1 * | 5/2012 | Srivastava | 701/119 |

OTHER PUBLICATIONS

Jee Hyoung Lee, et al., "Emergency Signal Generator," 2006 <http://courses.engr.illinois.edu/ece445/projects/fal12006/project5_final_paper.pdf>.

* cited by examiner

*Primary Examiner* — John A Tweel, Jr.
(74) *Attorney, Agent, or Firm* — McDermott Will & Emery LLP

(57) ABSTRACT

A computer-implemented method for assessing traffic status with sensors is provided. The method includes receiving sensor readings from a plurality of mobile sensors for detecting a traffic parameter and obtaining traffic information associated with the received sensor readings. The method also includes identifying a change in traffic based on the obtained traffic information and the received sensor reading, and determining whether a traffic incident has occurred based on the identified change. Systems and machine-readable media are also provided.

20 Claims, 5 Drawing Sheets

300

ASSESSING TRAFFIC STATUS WITH SENSORS

BACKGROUND

Traffic information may be made available to users. Such traffic information may include various information related to traffic such as, for example, traffic congestion status on certain roads.

SUMMARY

The subject technology relates to a computer-implemented method for assessing traffic status with sensors. The method includes receiving sensor readings from a plurality of mobile sensors for detecting a traffic parameter and obtaining traffic information associated with the received sensor readings. The method also includes identifying a change in traffic based on the obtained traffic information and the received sensor reading, and determining whether a traffic incident has occurred based on the identified change.

The subject technology further relates to a system for assessing traffic status with sensors. The system includes a memory storing executable instructions and a processor coupled to the memory configured to execute the stored executable instructions to receive, from a plurality of mobile sensors for detecting a traffic parameter, sensor readings generated based on a change in the traffic parameter, and obtain traffic information associated with the received sensor reading. The processor is also configured to identify a change in traffic based on the obtained traffic information and the received sensor readings, determine whether a traffic incident has occurred based on the identified change, and if determination is made that a traffic incident has occurred, provide for communicating the traffic incident to a user.

The disclosed technology also relates to a machine-readable storage medium comprising instructions stored therein, which when executed by processors, cause the processors to perform operations including receiving, from a plurality of mobile sensors for detecting traffic parameters, a plurality of sensor readings generated based on changes in the traffic parameters, wherein the plurality of sensor readings are associated with locations within predetermined distances from each other. The operations also include obtain traffic information associated with the received sensor reading, and if more than a predetermined number of the plurality of sensor readings is received, identifying a change in traffic based on the obtained traffic information and the received sensor reading. The operations further include determining whether a traffic incident has occurred based on the identified change, and if determination is made that a traffic incident has occurred, providing for communicating the traffic incident to a user.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

Certain features of the subject technology are set forth in the appended claims. However, for purposes of explanation, several aspects of the subject technology are set forth in the following figures.

DETAILED DESCRIPTION

Figure 1:
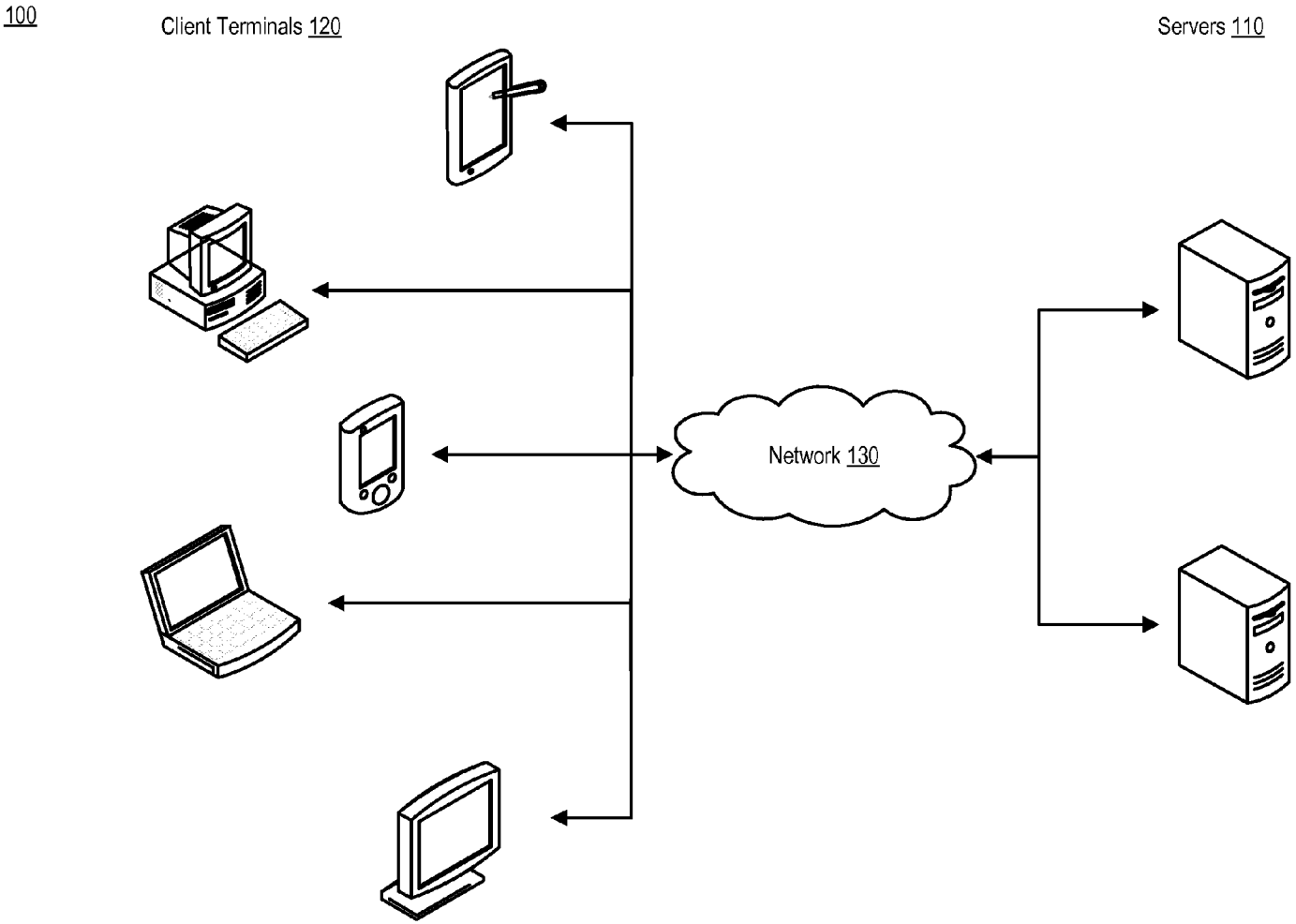
FIG. 1 illustrates an example architecture for assessing traffic status with sensors.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

Traffic information may be obtained via radio, Internet, or through mobile devices connected to a network (e.g., Internet). Such traffic information may include information for various types of traffic statuses such as, for example, traffic congestion statuses on certain roads. The various types of traffic statuses may be displayed on a screen such that a user may view a desired type of traffic status. For example, a user may wish to view the congestion status of a certain road. A screen displaying the traffic information may show the road as green if the road is not congested, and may show the road as red if the road is congested. While such information may show to the user whether a road is congested, the user would not be able to find out the cause of the congestion. Knowing the cause of the congestion may assist the user in making a sensible decision on taking an alternate route. For example, the user may make a more informed decision, knowing that the road is congested either because of a traffic incident (e.g., an accident, construction, road hazard, or road closure), or simply because there are too many vehicles on the road.

According to various aspects of the subject technology, a method and system for assessing traffic status with sensors is provided. Sensors associated with vehicles participating in traffic may be used to detect a potential incident. Such sensors may be, for example, sensors for detecting speed, location, acceleration, and sound. The sensors may also be gyroscopes. The sensors may be mobile sensors which are not fixed to a single location. Such mobile sensors may be for example, provided within mobile devices or vehicles. Sensors installed on the road or the roadside may also be used. Other types of sensing methods, for example, global positioning system (GPS) and cell tower triangulation, may also be used to detect a potential incident. The readings generated by such sensors may be used in conjunction with additional information associated with the sensors (e.g., location of the sensor, or device identifier of device in which sensors are installed) and general traffic information to determine a traffic incident.

Specifically, a sensor reading which may signify a traffic incident (e.g., a traffic accident, construction, road hazard, or road closure) may be generated using a sensor located inside a vehicle (e.g., a sensor part of a mobile device that is carried in the vehicle, or a sensor installed in a vehicle), a sensor located on the roadside (e.g., a speed camera) or a sensor installed beneath the road. For example, the sensor reading may indicate a sharp deceleration, a sharp acceleration, a reduced speed, a sudden loud noise, a sudden change of direction, or a shaking of the vehicle. Such sensor reading and additional information associated with the sensor (e.g., a location of the sensor or device identifier of device in which the sensor is installed) may be used as a "flag" to investigate the general traffic information to determine whether a significant change in traffic has occurred around (e.g., temporally and geographically) the location proximate to the sensor reading. For example, if the sensor reading indicates a sharp deceleration, the general traffic information is analyzed around the location of the sensor reading to determine if any traffic incident has occurred. The general traffic information may show a significantly reduced speed around the location of the sensor reading. In such case, the sensor reading may be determined as signifying a traffic incident. Such determination may be corroborated with additional information in the general traffic information which indicates an occurrence of a specific type of traffic incident around the location of the sensor reading. For example, the general traffic information may indicate an occurrence of a traffic accident, a road blockage, road hazard, construction, or other type of traffic incident around the location of the sensor reading that may be linked to the sensor reading. The information on the presence of the traffic incident alone may also be used as a basis for determining the sensor reading as signifying a traffic incident.

If no significant change in traffic is determined, or if no information on a traffic incident that may be linked to the sensor reading (e.g., sharp deceleration) is found near the location of the sensor reading, the sensor reading is not determined as signifying a traffic incident and may be considered as a false alarm. For example, after receiving a sensor reading which indicates a sharp deceleration, the general traffic information around the location of the sensor reading may be analyzed only to find that traffic around the location of the sensor reading is flowing smoothly and no indication of traffic incident that may be linked to a sharp deceleration may be found. In such case, the sharp deceleration may be deemed a false alarm. A single sensor reading may cause frequent false alarms. Therefore, multiple sensor readings of a similar nature generated using sensors within a certain distance from each other (e.g., multiple deceleration readings from sensors of vehicles within 10 ft. of each other) may be needed before a "flag" is raised and an investigation is made. If, based on the investigation, the sensor readings are determined as signifying a traffic incident, such determination may be communicated to the users of the system.

In an aspect of the subject technology, the general traffic information may indicate, for example, whether a certain road is congested, and/or the degree of congestion. The general traffic information may also indicate the speed of the traffic. The general traffic information may be obtained in various ways, such as, for example, from a traffic server which obtains traffic information through traffic sensors installed on the roads, and cameras. The traffic server may send out traffic information through various methods, such as, for example, sending via the internet, cellular networks or embedded within television signals, radio signals or satellite signals. The general traffic information may also be obtained through crowd-sourcing, where a plurality of users send in their speed and location information to determine the speed of the general traffic.

In an aspect of the subject technology, a central processing system may be provided to receive the sensor readings from the sensors and to obtain the general traffic information. The sensor readings may be received from different sensors located within vehicles, on the road, or on the roadside. The central processing system may identify the sensor readings that may serve as the flag to perform the investigation described above. After a "flag" sensor reading is determined to be a traffic incident, the system communicates such determination to the users.

In another aspect of the subject technology, the general traffic information may be pre-loaded within in-vehicle devices. Such in-vehicle devices may receive local sensor readings (e.g., from sensors located in the same vehicle) and determine a traffic incident based on the local sensor readings and the pre-loaded general traffic information.

FIG. 1 illustrates an example architecture 100 for assessing traffic status with sensors. The architecture 100 includes servers 110 and client terminals 120 connected over a network 130. Each of the client terminals 120 may include sensors capable of producing sensor readings for assessing traffic status. The client terminals 120 may also communicate with the servers 110 to assess traffic status with the sensors. The client terminals 120 may be, for example, mobile devices such as smartphones, tablet computers, PDAs, laptop computers or navigation systems and desktop computers that include the sensors capable of producing sensor readings for assessing traffic status.

The servers 110 may be any device having a processor, memory, and communications capability for communicating with the client terminals 120 or other sensors to receive sensor readings, obtain traffic information, and assess traffic status based on the received sensor readings and the obtained traffic information. The servers 110 may be a single server, or may be two or more servers communicating with each other. For example, the servers 110 may be multiple servers arranged in a cloud computing configuration.

The network 130 may include, for example, any one or more of a personal area network (PAN), a local area network (LAN), a campus area network (CAN), a metropolitan area network (MAN), a wide area network (WAN), a broadband network (BBN), the Internet, and the like. Further, the network 130 can include, but is not limited to, any one or more of the following network topologies, including a bus network, a star network, a ring network, a mesh network, a star-bus network, tree or hierarchical network, and the like.

Figure 2:
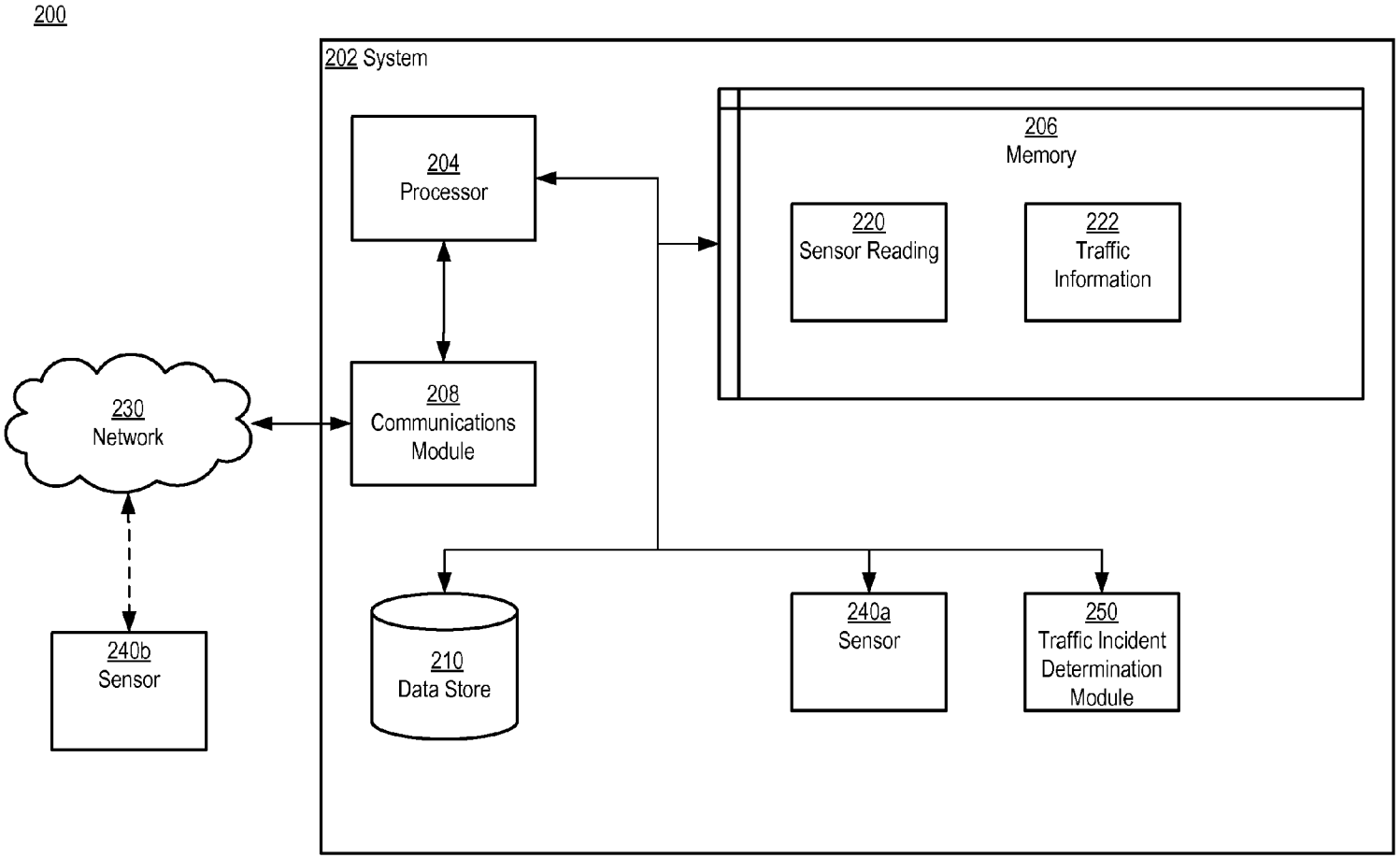
FIG. 2 is a block diagram illustrating an example system for assessing traffic status with sensors.

FIG. 2 is a block diagram 200 illustrating an example system 202 for assessing traffic status with sensors. The system 202 may be implemented, for example, at one of the client terminals 120, at one of servers 110, or spread across servers 110 and client terminals 120*a*-120*e*. The system 202 includes a processor 204 and a memory 206. The system 202 may also include a communications module 208, and may be connected to a network 230 via the communications module 208. The network 230 may be, for example, the network 130 of FIG. 1. The communications module 208 may be configured to interface with the network 230 to send and receive information, such as data, requests, responses, and commands to other devices (e.g., servers 110 or client terminals 120) or systems on the network 230. The communications module 208 may be, for example, modems, Ethernet cards or mobile broadband adaptors.

The memory 206 includes a sensor reading 220 and traffic information 222. The sensor reading may be generated by and received from various sensors for detecting various information which may be used in determining a traffic incident. For example, the sensors may be sensors for detecting acceleration, change in direction, velocity, ambient sound, temperature, humidity, or wind speed. The sensors may also be gyroscopes or video cameras. The traffic information 222 may include various types of traffic status information for a certain geographic area. The various types of traffic status information may include, for example, congestion status for certain roads, construction information, road closure information, or accident information.

The system 202 also includes a traffic incident determination module 250. The traffic incident determination module 250 contains logic for determining whether a traffic incident has occurred based on the sensor reading 220 and the traffic information 222. The traffic incident determination module 250 may be in communication with the processor 204 and the memory 206, or may be integrated with the memory 206.

The system 202 may also include a data store 210, which may also store the sensor reading 220 and/or the traffic information 222. The data store 210 may be integrated with the memory 206, or may be independent from the memory and be in communication with the processor 204 and the memory. The data store 210 may also be implemented to be independent from the system 202 and in communication with the system.

The system 202 may also include a sensor 240*a* which may be used for generating the sensor reading 220. The system 202 may also be in communication with a sensor 240*b* through the network 230. The sensor 240*b* may also be used for generating the sensor reading 220. Sensor 240*a* and sensor 240*b* may be collectively called the sensor 240.

The processor 204 is configured to execute instructions, such as instructions physically coded into the processor, instructions received in the form of software from the memory 206, or a combination of both. For example, the processor 204 is configured to execute instructions to receive a sensor reading (e.g., sensor reading 220) from a sensor (e.g., sensor 240) for detecting a traffic parameter, and obtain traffic information (e.g., traffic information 222) for a location associated with the received sensor reading. The processor 204 is also configured to identify a change in traffic based on the obtained traffic information and the received sensor reading, and determine that a traffic incident has occurred based on the identified change. The processor 204 may also be configured to provide for communicating the traffic incident to a user.

Figure 3:
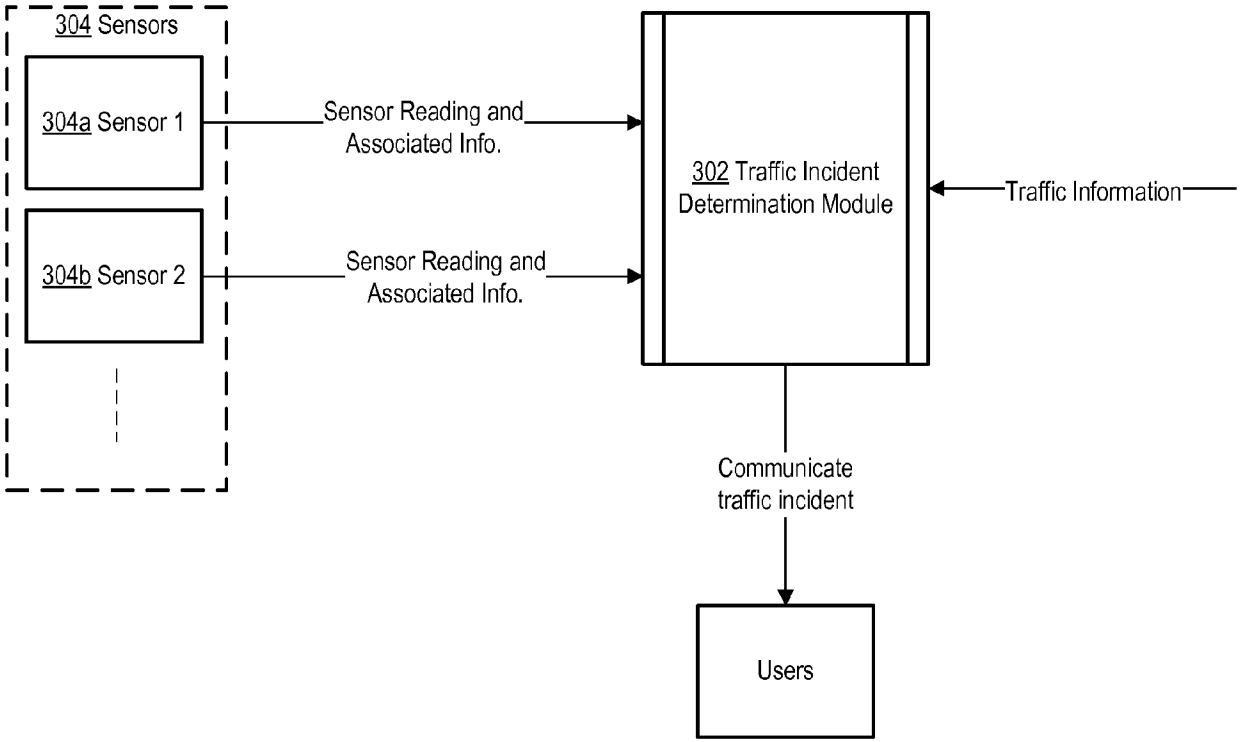
FIG. 3 is a diagram illustrating example operations assessing traffic status with sensors.

FIG. 3 is a diagram 300 illustrating example operations for assessing traffic status using sensors. The operations may be performed, for example, by system 202.

Diagram 300 shows two sensors 304*a* and 304*b* (collectively, sensors 304). However, the sensors 304 may include more than two sensors. When a sensor 304 (e.g., sensor 304*a* or sensor 304*b*) makes a detection which may indicate a traffic incident, a sensor reading is generated, and the generated sensor reading is communicated to the traffic incident determination module 302 (e.g., traffic incident determination module 250). The sensors 304 may be installed in mobile devices that are travelling inside a traffic vehicle, or may be installed in the traffic vehicles. The sensors 304 may also be installed on the road or on the road side. The sensors 304 may be sensors for detecting parameters related to traffic such as, for example, speed sensors, accelerometers, gyroscopes or video cameras. Sensors for detecting sound, location or other types of traffic parameters may also be used.

When a sensor 304 detects a change in a traffic parameter (e.g., speed, acceleration, or sound) exceeding a predetermined threshold, a corresponding sensor reading (e.g., sensor reading 220) is generated and the sensor reading is received at the traffic incident determination module 302. For example, a sensor 304 may detect a sudden deceleration and generate a corresponding sensor reading. Additional information associated with the sensor 304 such as, for example, the time and location at which the detection was made, or an identifier identifying the device or vehicle at which the detection was made, may also be received at the traffic incident determination module 302.

The traffic incident determination module 302 has access to traffic information (e.g., traffic information 222). The traffic information includes, for example, historical and current speed of the general traffic on certain roads. The traffic information may be received from servers which provide traffic information such as, for example, radio stations, television broadcasting stations, or servers on the Internet. The traffic information may also be generated based on information received from a plurality of users ("crowd-sourcing"). For example, a user may send individual traffic information, such as, for example, that construction is going on at a certain point on a road, to a crowd-sourcing server. A user may also have agreed to automatically send his/her speed information to the crowd-sourcing server while participating in traffic. The crowd-sourcing server may receive multiple such individual traffic information from multiple participating users to generate a general traffic information.

Receiving the sensor reading and the additional information associated with the sensor 304 serves as an indicator, or a "flag," to determine whether a traffic incident has occurred. Using the additional information associated with the sensor 304 (e.g., location at which the detection which may indicate a traffic incident was made) received with the sensor reading, the time and location at which the detection was made is identified. The traffic information at and/or around the identified time and location is then analyzed to determine whether a change exceeding a predetermined threshold has occurred in the general traffic.

If it is determined that a change exceeding the predetermined threshold has occurred at the identified time and location, the change may be determined as being caused by a traffic incident (e.g., an accident or natural disaster affecting traffic). For example, the traffic information at or around the identified time and location may show a sudden decrease in the general traffic speed. If such decrease occurred at a rate exceeding a predetermined threshold, the decrease in the general traffic speed may be determined as being caused by a traffic incident. If it is determined that the change in the general traffic is caused by a traffic incident, notification may be made to users. For example, an alert may be issued to users who have previously indicated that they wish to receive information on traffic incidents.

In an aspect of the subject technology, analysis of the traffic information is made after a predetermined number of sensor readings of similar nature that are associated with locations within a certain proximity from each other are received, since a small number of sensor readings may be false alarms. For example, analysis of the traffic information is not made until after 3 sensor readings indicating a decrease in speed or deceleration that are associated with sensors within 10 feet from each other are received.

Diagram 300 shows that multiple sensor readings 304 are sent to a single traffic incident determination module 302 which has access to current and historical traffic information. However, the traffic information may also be pre-loaded on devices or vehicles on which the sensors 304 are installed, and determination of traffic incidents may be made at each such device or vehicle based on the pre-loaded traffic information and local sensor reading that is generated using the respective sensor 304 installed at each device or vehicle.

Figure 4:
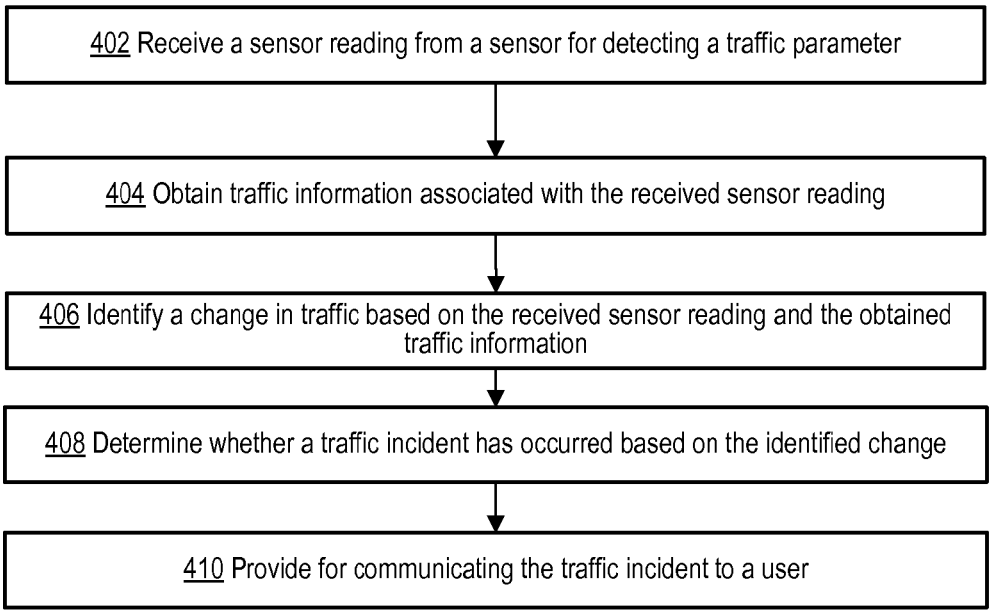
FIG. 4 illustrates an example flow diagram of example processes for assessing traffic status with sensors.

FIG. 4 illustrates a flow diagram of example processes 400 for assessing traffic status using sensors. The processes of FIG. 4 may be performed by, for example, system 202. However, the operations of FIG. 4 are not limited to such a system, and may be performed using other systems/configurations.

Process 400 begins at block 402 where a sensor reading from a sensor for detecting a traffic parameter is received. The traffic parameter may be speed, acceleration, location or sound. The sensor may be a speed sensor, an accelerometer, a global GPS receiver, or a gyroscope. The sensor reading may be generated based on detection of a change in the traffic parameter which exceeds a predetermined threshold. Location information and temporal information associated with the sensor reading (e.g., location and time at which the change in traffic parameter exceeding the threshold is detected) may also be received. At block 404, traffic information associated with the received sensor reading is obtained.

At block 406, a change in traffic is identified based on the sensor reading received at block 402 and the traffic information obtained at block 404. At block 408, determination is made whether a traffic incident has occurred based on the identified change. Determination may be made that the traffic incident has occurred if the identified change exceeds a predetermined threshold. At block 410, provision is made for communicating the traffic incident to a user.

In an aspect of the subject technology, at block 402, a plurality of sensor readings from a plurality of sensors may be received, where the plurality of sensor readings are associated with locations within predetermined distances from each other. Also, at block 406, change in the traffic is identified if more than a predetermined number of the plurality of sensor readings is received.

Figure 5:
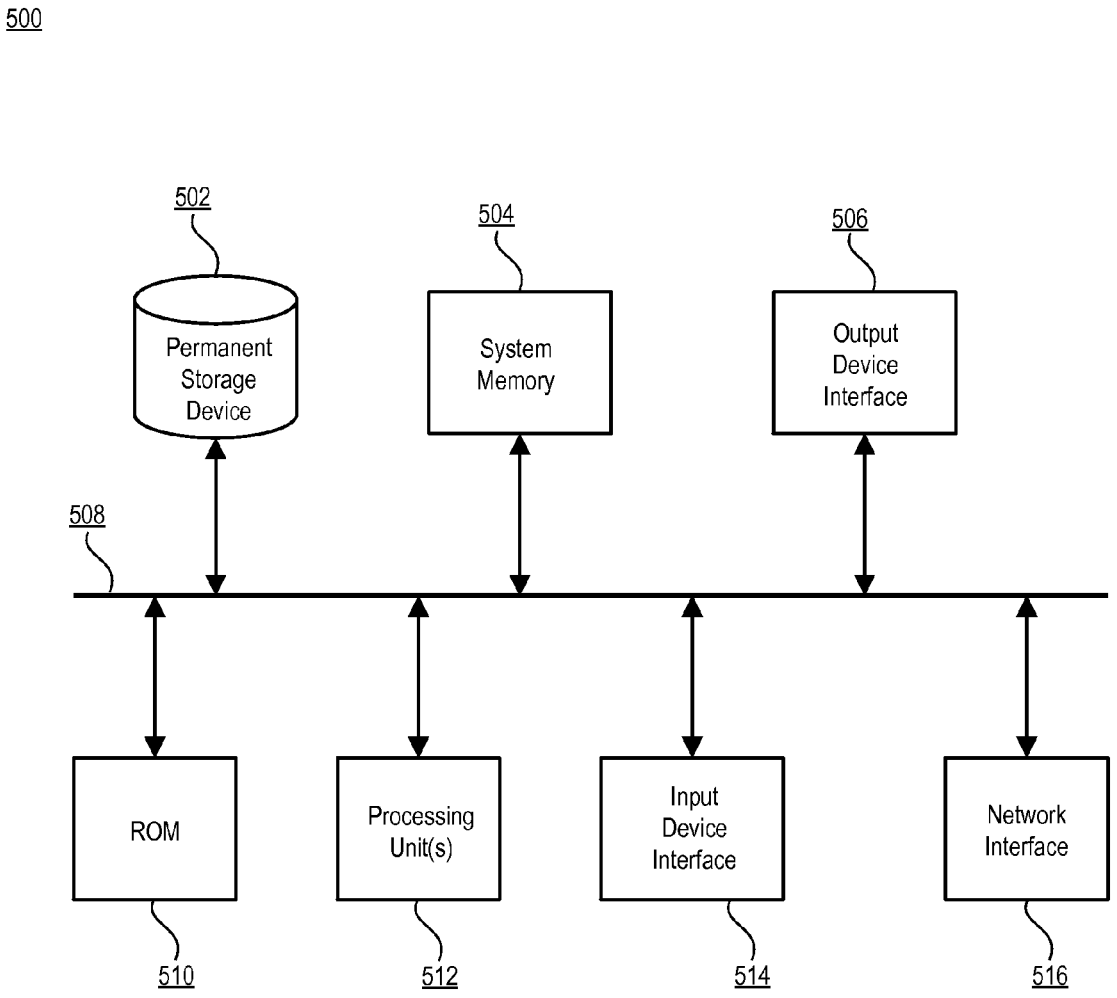
FIG. 5 conceptually illustrates an electronic system with which some implementations of the subject technology are implemented.

FIG. 5 conceptually illustrates an electronic system with which some implementations of the subject technology are implemented. Electronic system 500 can be a computer, phone, PDA, or any other sort of electronic device. Such an electronic system includes various types of computer-readable media and interfaces for various other types of computer-readable media. Electronic system 500 includes a bus 508, processing unit(s) 512 (e.g., processor(s)), a system memory 504, a read-only memory (ROM) 510, a permanent storage device 502, an input device interface 514, an output device interface 506, and a network interface 516.

Bus 508 collectively represents all system, peripheral, and chipset buses that communicatively connect the numerous internal devices of electronic system 500. For instance, bus 508 communicatively connects processing unit(s) 512 with ROM 510, system memory 504, and permanent storage device 502. From these various memory units, processing unit(s) 512 retrieves instructions to execute and data to process in order to execute the processes of the subject disclosure. The processing unit(s) can be a single processor or a multi-core processor in different implementations.

ROM 510 stores static data and instructions that are needed by processing unit(s) 512 and other modules of the electronic system. Permanent storage device 502, on the other hand, is a read-and-write memory device. This device is a non-volatile memory unit that stores instructions and data even when electronic system 500 is off Some implementations of the subject disclosure use a mass-storage device (such as a magnetic or optical disk and its corresponding disk drive) as permanent storage device 502.

Other implementations use a removable storage device (such as a floppy disk, flash drive, and its corresponding disk drive) as permanent storage device 502. Like permanent storage device 502, system memory 504 is a read-and-write memory device. However, unlike storage device 502, system memory 504 is a volatile read-and-write memory, such as a random access memory. System memory 504 stores some of the instructions and data that the processor needs at runtime. In some implementations, the processes of the subject disclosure are stored in system memory 504, permanent storage device 502, and/or ROM 510. From these various memory units, processing unit(s) 512 retrieves instructions to execute and data to process in order to execute the processes of some implementations.

Bus 508 also connects to input and output device interfaces 514 and 506. Input device interface 514 enables the user to communicate information and select commands to the electronic system. Input devices used with input device interface 514 include, for example, alphanumeric keyboards and pointing devices (also called "cursor control devices"). Output device interface 506 enables, for example, the display of images generated by the electronic system 500. Output devices used with output device interface 506 include, for example, printers and display devices, such as cathode ray tubes (CRT) or liquid crystal displays (LCD). Some implementations include devices such as a touchscreen that functions as both input and output devices.

Finally, as shown in FIG. 5, bus 508 also couples electronic system 500 to a network (not shown) through a network interface 516. In this manner, the computer can be a part of a network of computers (such as a local area network ("LAN"), a wide area network ("WAN"), an Intranet, or a network of networks, such as the Internet. Any or all components of electronic system 500 can be used in conjunction with the subject disclosure.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessors or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer-readable medium" and "computer-readable media" are entirely restricted to tangible, physical objects that store information in a form that is readable by a computer. These terms exclude any wireless signals, wired download signals, and any other ephemeral signals.

To provide for interaction with a user, implementations of the subject technology described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user.

Aspects of the subject technology described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject technology described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some aspects, a server transmits data (e.g., an HTML page) to a client device (e.g., for purposes of displaying data to and receiving user input from a user interacting with the client device). Data generated at the client device (e.g., a result of the user interaction) can be received from the client device at the server.

It is understood that any specific order or hierarchy of steps in the processes disclosed is an illustration of example approaches. Based upon design preferences, it is understood that the specific order or hierarchy of steps in the processes may be rearranged, or that not all illustrated steps be performed. Some of the steps may be performed simultaneously. For example, in certain circumstances, multitasking and parallel processing may be advantageous. Moreover, the separation of various system components in the aspects described above should not be understood as requiring such separation in all aspects, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

All structural and functional equivalents to the elements of the various aspects described throughout this disclosure that are known or later come to be known to those of ordinary skill in the art are expressly incorporated herein by reference and are intended to be encompassed by the claims.

What is claimed is:

1. A computer-implemented method for assessing traffic incidents with sensors, the method comprising:

receiving sensor readings from a plurality of mobile sensors for detecting a traffic parameter;

obtaining traffic information associated with the received sensor readings;

identifying a change in traffic based on the obtained traffic information and the received sensor readings;

determining, for each received sensor reading, that the received sensor reading is a false alarm if the received sensor reading does not match general traffic information around the location where the sensor reading is taken; and determining, if at least one received sensor reading is not a false alarm, whether a traffic incident has occurred based on the identified change.

2. The method of claim 1, wherein the sensor readings are generated based on a change in the traffic parameter, wherein the change exceeds a predetermined threshold.

3. The method of claim 1, wherein the determining comprises determining that the traffic incident has occurred if the identified change exceeds a predetermined threshold.

4. The method of claim 1, wherein the sensor readings received from the plurality of mobile sensors are associated with locations within predetermined distances from each other, and wherein the identifying the change in the traffic comprises identifying the change in traffic based on the obtained traffic information and the sensor readings.

5. The method of claim 1, wherein the traffic parameter comprises at least one of speed, acceleration, location, or sound.

6. The method of claim 1, wherein the plurality of mobile sensors comprise at least one of speed sensor, an accelerometer, a GPS receiver, or a gyroscope.

7. The method of claim 1, wherein the traffic information is generated by crowd-sourcing.

8. The method of claim 1, wherein the traffic information is received from at least one of the Internet, cellular networks, television signals, radio signals or satellite signals.

9. The method of claim 1, further comprising receiving location information and temporal information associated with the sensor readings.

10. The method of claim 9, wherein the identifying the change further comprises identifying the change in the traffic based on the received location information and the temporal information.

11. The method of claim 1, wherein the traffic information comprises current traffic information and historical traffic information.

12. The method of claim 1, wherein at least one of the plurality of mobile sensors is associated with a vehicle participating in traffic.

13. The method of claim 1, wherein the change in the traffic comprises a change in general speed of the traffic.

14. The method of claim 1, wherein the traffic information associated with the received sensor readings comprises traffic information of traffic that is proximate to a location of one the received sensor readings.

15. The method of claim 1, further comprising, if determination is made that a traffic incident has occurred, providing for communicating the traffic incident to a user.

16. A system for assessing traffic status with sensors, the system comprising:

a memory storing executable instructions; and a processor coupled to the memory configured to execute the stored executable instructions to:

receive, from a plurality of mobile sensors for detecting a traffic parameter, sensor readings generated based on a change in the traffic parameter;

obtain traffic information associated with the received sensor readings;

identify a change in traffic based on the obtained traffic information and the received sensor readings;

determine, for each received sensor reading, that the received sensor reading is a false alarm if the received sensor reading does not match general traffic information around the location where the sensor reading is taken;

determine, if at least one received sensor reading is not a false alarm, whether a traffic incident has occurred based on the identified change; and if determination is made that a traffic incident has occurred, provide for communicating the traffic incident to a user.

17. The system of claim 16, wherein the change exceeds a predetermined threshold.

18. The system of claim 16, wherein the determining comprises determining that the traffic incident has occurred if the identified change exceeds a predetermined threshold.

19. The system of claim 16, wherein sensor readings received from the plurality of mobile sensors are associated with locations within predetermined distances from each other, and wherein the identifying the change in the traffic comprises identifying the change in traffic based on the obtained traffic information and the received sensor readings.

20. A machine-readable storage medium comprising instructions stored therein, which when executed by processors, cause the processors to perform operations comprising:

receiving, from a plurality of mobile sensors for detecting traffic parameters, a plurality of sensor readings generated based on changes in the traffic parameters, wherein the plurality of sensor readings are associated with locations within predetermined distances from each other;

obtaining traffic information associated with the received sensor readings;

if more than a predetermined number of the plurality of sensor readings is received, identifying a change in traffic based on the obtained traffic information and the received sensor readings;

determining, for each received sensor reading, that the received sensor reading is a false alarm if the received sensor reading does not match general traffic information around the location where the sensor reading is taken;

determining, if at least one received sensor reading is not a false alarm, whether a traffic incident has occurred based on the identified change; and if determination is made that a traffic incident has occurred, providing for communicating the traffic incident to a user.

* * * * *